US011599068B2

(12) United States Patent
Tanabe

(10) Patent No.: US 11,599,068 B2
(45) Date of Patent: Mar. 7, 2023

(54) ELECTRONIC TIMEPIECE

(71) Applicant: Seiko Epson Corporation, Tokyo (JP)

(72) Inventor: Takuya Tanabe, Shiojiri (JP)

(73) Assignee: SEIKO EPSON CORPORATION

( * ) Notice: Subject to any disclaimer, the term of this patent is extended or adjusted under 35 U.S.C. 154(b) by 440 days.

(21) Appl. No.: 16/823,381

(22) Filed: Mar. 19, 2020

(65) Prior Publication Data

US 2020/0301373 A1 Sep. 24, 2020

(30) Foreign Application Priority Data

Mar. 20, 2019 (JP) ..... JP2019-052433

(51) Int. Cl.
*G04R 40/06* (2013.01)
*G04R 20/10* (2013.01)
*G04C 11/00* (2006.01)

(52) U.S. Cl.
CPC ..... *G04R 40/06* (2013.01); *G04C 11/02* (2013.01); *G04R 20/10* (2013.01)

(58) Field of Classification Search
CPC ..... G04R 40/06; G04R 20/10; G04R 20/00; G04C 11/02
See application file for complete search history.

(56) References Cited

U.S. PATENT DOCUMENTS

2010/0220555 A1* 9/2010 Honda ..... G04R 20/04 368/14
2013/0107677 A1* 5/2013 Willemin ..... G04C 3/067 368/200
2015/0003212 A1* 1/2015 Imamura ..... G04R 20/02 368/47
2016/0259303 A1* 9/2016 Fujisawa ..... G04R 20/10

FOREIGN PATENT DOCUMENTS

JP 2013-253925 A 12/2013
JP 2015-010898 A 1/2015
JP 2016-161467 A 9/2016
WO WO-2008-108417 A1 9/2008

* cited by examiner

*Primary Examiner* — Edwin A. Leon
*Assistant Examiner* — Kevin Andrew Johnston
(74) *Attorney, Agent, or Firm* — Harness, Dickey & Pierce, P.L.C.

(57) ABSTRACT

Provided is a radio-controlled timepiece that can reduce overall power consumption. The radio-controlled timepiece 1 has a receiver circuit 12 that executes during a specific time limit a reception process to acquire multiple time data from the standard time signals at different times; storage 22 that stores multiple time data; a timekeeper 23 that keeps an internal time; a time setting adjuster 24 that corrects the internal time based on coherent time data when the number of coherent time data, which is time data that is mutually coherent, in the multiple time data reaches a threshold; and a reception controller 21 that extends the time limit when the number of coherent time data is less than the threshold when a specific time that is shorter than the time limit has past since the reception process started.

5 Claims, 8 Drawing Sheets

| SEC-OND | MEANING | SEC-OND | MEANING | SEC-OND | MEANING |
|---|---|---|---|---|---|
| 0 | Marker (0.2 s) | 20 | Fixed (0.8 s) | 40 | Reserved (SU2) |
| 1 | Minute (40) | 21 | Fixed (0.8 s) | 41 | Year (80) |
| 2 | Minute (20) | 22 | Days (200) | 42 | Year (40) |
| 3 | Minute (10) | 23 | Days (100) | 43 | Year (20) |
| 4 | Fixed (0.8 s) | 24 | Fixed (0.8 s) | 44 | Year (10) |
| 5 | Minute (8) | 25 | Days (80) | 45 | Year (8) |
| 6 | Minute (4) | 26 | Days (40) | 46 | Year (4) |
| 7 | Minute (2) | 27 | Days (20) | 47 | Year (2) |
| 8 | Minute (1) | 28 | Days (10) | 48 | Year (1) |
| 9 | Postion marker (0.2 s) | 29 | Postion marker (0.2 s) | 49 | Postion marker (0.2 s) |
| 10 | Fixed (0.8 s) | 30 | Days (8) | 50 | Day of week (4) |
| 11 | Fixed (0.8 s) | 31 | Days (4) | 51 | Day of week (2) |
| 12 | Hour (20) | 32 | Days (2) | 52 | Day of week (1) |
| 13 | Hour (10) | 33 | Days (1) | 53 | Leap second information (LS1) |
| 14 | Fixed (0.8 s) | 34 | Fixed (0.8 s) | 54 | Leap second information (LS2) |
| 15 | Hour (8) | 35 | Fixed (0.8 s) | 55 | Fixed (0.8 s) |
| 16 | Hour (4) | 36 | Parity (PA1) | 56 | Fixed (0.8 s) |
| 17 | Hour (2) | 37 | Parity (PA2) | 57 | Fixed (0.8 s) |
| 18 | Hour (1) | 38 | Reserved (SU1) | 58 | Fixed (0.8 s) |
| 19 | Postion marker (0.2 s) | 39 | Postion marker (0.2 s) | 59 | Postion marker (0.2 s) |

FIG. 2

| | Time data |
|---|---|
| 1st time | 2029:12:15 18:18 |
| 2nd time | 2019:10:15 16:11 |
| 3rd time | 2019:10:25 16:25 |
| 4th time | 2019:10:15 19:13 |
| 5th time | 2019:10:15 16:14 |
| 6th time | 2019:10:25 16:15 |
| 7th time | 2039:10:15 16:16 |
| 8th time | 2010:10:10 16:17 |
| 9th time | 2019:10:15 20:18 |
| ... | ... |

FIG. 4

ELECTRONIC TIMEPIECE

BACKGROUND

1. Technical Field

The present invention relates to an electronic timepiece.

The present application claims priority based on and incorporates by reference the entire contents of Japanese Patent Application No. 2019-052433 filed on Mar. 20, 2019.

2. Related Art

JP-A-2016-161467 describes an electronic timepiece that determines whether or not reception was successful when the coherence of multiple time data acquired from standard time signals at different times is confirmed.

With the technology described in JP-A-2016-161467, however, when the coherence of multiple time data is not confirmed within a limited time, the reception process is executed again at another opportunity, and power consumption approximately the same as the first time the reception process executes is required.

SUMMARY

A first aspect of the present disclosure is a radio-controlled timepiece including: an antenna configured to receive standard time signals; a receiver circuit configured to execute during a specific time limit a reception process to acquire multiple time data from the standard time signals at different times; storage configured to store the multiple time data; a timekeeper configured to keep internal time; a time adjuster configured to correct the internal time based on coherent time data when the number of coherent time data, which is time data that is mutually coherent, in the multiple time data reaches a threshold; and a reception controller configured to extend the time limit when the number of coherent time data is less than the threshold when a specific time that is shorter than the time limit has past since the reception process started.

In a second aspect of the present disclosure, the reception controller in the first aspect of the present disclosure extends the time limit when a difference between the threshold and the number of coherent time data is 1.

In a third aspect of the present disclosure, the reception controller in the second aspect of the present disclosure extends the time limit when multiple time data other than the coherent time data includes two time data each containing mutually coherent information in part thereof.

In a fourth aspect of the present disclosure, the reception controller in the second aspect of the present disclosure extends the time limit when a difference between the threshold and the number of coherent time data is two, and the multiple time data other than the coherent time data includes two time data each containing mutually coherent information in part thereof.

A fifth aspect of the present disclosure is any of the first to fourth aspects of the present disclosure wherein an upper limit is set for the number of times the reception controller extends the time limit.

BRIEF DESCRIPTION OF THE DRAWINGS

FIG. 2 is a table describing the time code format of the JJY standard time signal.

FIG. 4 describes an example of multiple time data stored in storage.

DESCRIPTION OF EMBODIMENTS

Figure 1:
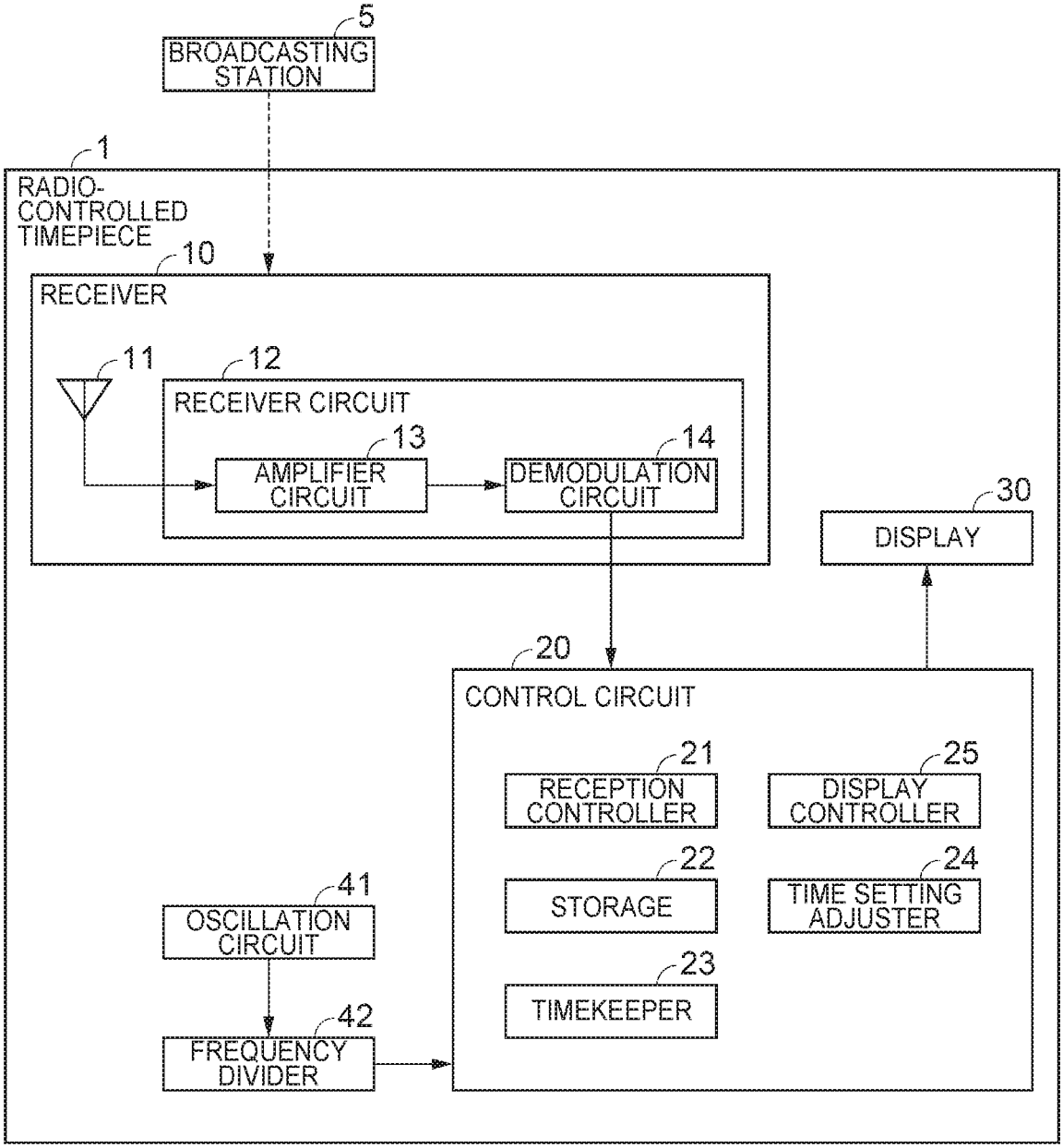
FIG. 1 is a block diagram illustrating the configuration of a radio-controlled timepiece.

A preferred embodiment of the present disclosure is described below with reference to the accompanying figures. Identical or similar elements in the figures are identified by the same or similar reference numerals, and redundant description thereof is omitted. The scope of the accompanying claims is not limited to the content of the embodiments described below. All configurations described in the following embodiments are also not necessarily required configurations of the present disclosure. The technical scope of the invention may also be varied in many ways without departing from the technical scope of the accompanying claims.

Radio-Controlled Timepiece

As shown in FIG. 1, a radio-controlled timepiece 1 according to this embodiment includes a receiver 10 that receives radio signals, a control circuit 20 that processes operations required for the operation of the radio-controlled timepiece 1, a display 30 that displays time, an oscillation circuit 41, and a frequency divider 42. The radio-controlled timepiece 1 in this example is a wristwatch typically worn on the user's wrist. The radio-controlled timepiece 1 may also be configured as another type of mobile timepiece, a table clock, or a wall clock, for example.

The receiver 10 includes an antenna 11 and a receiver circuit 12.

The antenna 11 receives standard time signals transmitted from broadcasting stations 5 in various locations.

The receiver circuit 12 includes an amplifier circuit 13 that amplifies standard time signals received through the antenna 11, for example, and a demodulation circuit 14 that acquires time data by demodulating the signal amplified by the amplifier circuit 13.

More specifically, the receiver circuit 12 acquires time data as a binary signal by selectively acquiring the type of standard time signal specified by the control circuit 20, acquiring an envelope signal by detection processing the acquired signal, and digitizing the envelope signal. In response to control by the control circuit 20, the receiver circuit 12 executes the reception process to acquire multiple time data from standard time signals at different times within a previously set time limit. The receiver circuit 12 then outputs the time data acquired from the standard time signals to the control circuit 20.

In the example in FIG. 2, the time code format of the standard time signal transmits one bit per second, the meaning of each bit is specifically defined, and one complete time code is transmitted every 60 seconds. FIG. 2 is a table describing the time code format of the JJY (R) transmitted in Japan. The parameters defined by each bit of the JJY signal format are the minute and hour of the current time, the number of days since January 1 of the current year, the year (the last two digits of the Gregorian calendar year), the day of the week, and leap second information. The value of each parameter is determined by a combination of values assigned to each bit.

Figure 3:
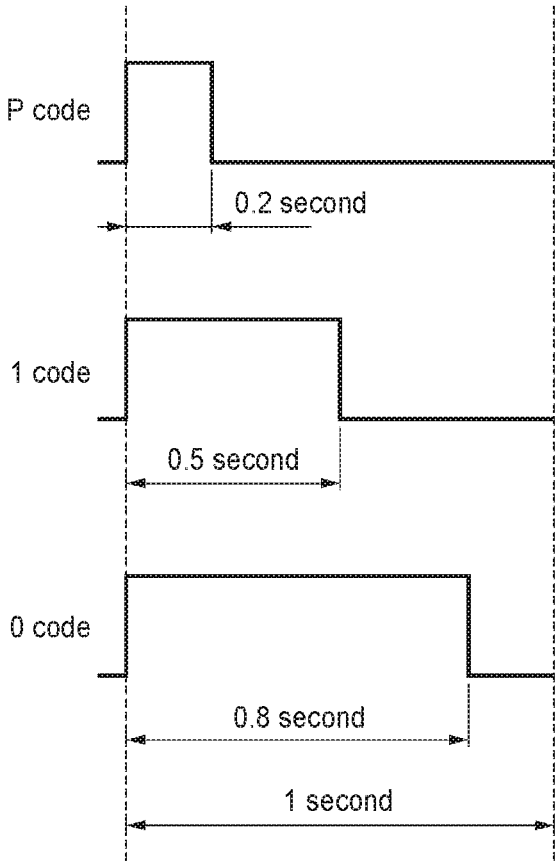
FIG. 3 is a timing chart three code types in the standard time signal.

More specifically, as shown in FIG. 3, a complete time signal carrying different time data is transmitted once a minute by the broadcasting station 5 transmitting a P code, 1 code, or 0 code every second according to the time code format.

The P code is a signal with a pulse width of 0.2 s+/−5 ms.

A 1 code is a signal with a pulse width of 0.5 s+/−5 ms.

A 0 code is a signal with a pulse width of 0.8 s+/−5 ms.

The time signal contains a P code as a marker bit transmitted every 10 seconds from the bit at second 9.

The 0 second bit and the 59 second bit of the time signal are consecutive P codes, and the 0 second bit thereby marks the 0 second of each minute.

Note that in the JJY format a parity bit PA1 corresponding to the hour and a parity bit PA2 corresponding to the minute are defined between the bit train of the day count and the bit train of the year value.

The control circuit 20 is a processing circuit including, for example, a reception controller 21, storage 22, a timekeeper 23, a time setting adjuster 24, and a display controller 25. The control circuit 20 may be configured by a logic circuit or other circuit components such as a CPU (central processing unit) or microcontroller. The control circuit 20 configures a computer system that processes operations required for the radio-controlled timepiece 1 to operate, for example. The control circuit 20 embodies functions described herein by executing programs stored in the storage 22, for example.

The reception controller 21 controls operation of the receiver circuit 12. The reception controller 21 executes the reception process of the receiver circuit 12 at a specific timing, such as at 2:00 a.m. every day. The reception controller 21 controls the receiver circuit 12 to execute the reception process continuously for a previously set limited time. In addition, the reception controller 21 can also change the standard time signal to receive by changing the frequency used for demodulation in the receiver circuit 12.

The storage 22 is a storage device such as semiconductor memory. The storage 22 stores data and a program defining a series of steps required for control circuit 20 operation, and is a computer-readable storage medium. The storage 22 is not limited to nonvolatile auxiliary memory, and may include primary storage such as a register or cache memory included in a CPU. The storage 22 may be configured by a single hardware device or configured by multiple discrete hardware devices.

As shown in FIG. 4, the storage 22 stores multiple time data acquired periodically by the reception process of the receiver circuit 12.

When the reception process starts, the receiver circuit 12 acquires multiple binary time data and outputs to the control circuit 20 by amplifying and demodulating standard time signals carrying different time data once a minute. The control circuit 20 sequentially decodes the multiple binary time data, and sequentially stores the multiple decoded time data in the storage 22. As a result, the storage 22 accumulates the multiple time data acquired from the start to the end of the reception process.

The timekeeper 23 keeps internal time based on a reference signal generated by the oscillation circuit 41 and frequency divider 42. The oscillation circuit 41 outputs the oscillation signal acquired by applying voltage to a crystal oscillator, for example, to the frequency divider 42.

The frequency divider 42 then outputs to the timekeeper 23 a reference signal of a specific frequency acquired by frequency dividing the oscillation signal input from the oscillation circuit 41.

The internal time kept by the timekeeper 23 based on the reference signal can be adjusted by the time setting adjuster 24.

When the number of coherent time data, which is time data contained in the multiple time data that is stored in the storage 22 and determined to be mutually coherent, exceeds a specific threshold, the time setting adjuster 24 uses the coherent time data to adjust the internal time kept by the timekeeper 23. In the example in FIG. 4, the second and fifth time data are determined to be coherent because the time difference therebetween is three minutes. In this example the threshold is 3. As a result, the number of coherent time data in the example shown in FIG. 4 is two, and the threshold has not been reached.

In this example data having coherency means, for example, that the difference between the time indicated by each time data, and the difference between the times when the time data was received, is the same for a specific multiple number of time data.

To determine coherence, the time setting adjuster 24 may also use only time data that indicate a rational time. For example, if the time data indicates a value that does not exist in the standard time signal, such as an hour value of 25, the time setting adjuster 24 may determine the time data is not rational and therefore not evaluate the coherence of that time data with any other time data.

The time setting adjuster 24 corrects the internal time kept by the timekeeper 23 to the current time coherent with the coherent time data.

In this example, when the time indicated by the coherent time data is defined referenced to the time when the coherent time data was received, the current time coherent with the coherent time data is the time at the time the time setting adjuster 24 corrects the internal time. The time setting adjuster 24 thus adjusts the internal time using the coherent time data.

If the number of coherent time data is less than the threshold when a specific time shorter than the time limit from the start of the reception process has past, the reception controller 21 extends the time limit.

Assume, for example, the time limit of the reception process is 12 minutes, and the specific time is one second less than the time limit. In this case, if the difference between the threshold and the number of coherent time data is a specific value when 11 minutes 59 seconds have past since the reception process started, the reception controller 21 extends the time limit one minute.

The difference between the threshold and the number of coherent time data means the difference between the number of coherent time data and the threshold. In this example, the threshold is 3 and the specific value of the difference is 1.

The display controller 25 controls the display 30 to display the internal time kept by the timekeeper 23.

The display 30 may be an analog or a digital display. If an analog display, the display 30 comprises, for example, a stepper motor or other actuator, a wheel train, hands, and a dial. If a digital display, the display 30 comprises, for example, an LCD device, and OLED device, or other type of display device, and a driver circuit that drives the display device. The display 30 may be any type of device that displays the internal time kept by the timekeeper 23 to the user.

Radio-Controlled Timepiece Operation

A method whereby the radio-controlled timepiece 1 corrects the time is described below as an example of an operation of the radio-controlled timepiece 1 with reference to the flow chart in FIG. 5. In this example, the process described below starts at a specific time, such as 2:00 a.m. every day.

First, in step 101, the reception controller 21 controls the receiver circuit 12 to start the time signal reception process at a specific timing based on the internal time kept by the timekeeper 23.

In step 102, the reception controller 21 selects the broadcasting station 5 transmitting the time signal the receiver 10 is to receive. More specifically, the type of standard time signal, or more specifically the carrier frequency and time code format of the standard time signal, transmitted by each broadcasting station 5 from which signals can be received are previously stored, and the control circuit 20 selects a broadcasting station 5 by changing the type of time signal the receiver circuit 12 is to receive.

In step 103, the reception controller 21 executes a second synchronization process with the time signal input from the receiver circuit 12, or more specifically the digitized time data, and determines whether or not the second synchronization process was successful.

More specifically, the reception controller 21 determines the reception process was successful by confirming that the change in the signal level of the time signal occurs at a one-second period. If the second synchronization process is successful, the reception controller 21 goes to step S104, and if the second synchronization process fails, the reception controller 21 goes to step S114.

In step 104, the reception controller 21 detects a marker in the time signal input from the receiver circuit 12. For example, the reception the reception controller 2*l* detects the 10-second periods in each minute by detecting the P code, and by detecting two consecutive P codes, detects the 0 second marking the start of a time code. If the reception controller 21 fails to detect a marker in step S104, the reception controller 21 proceeds to step S114.

In step 105, the control circuit 20 acquires one decoded time code by decoding the time signal input from the receiver circuit 12, that is, by decoding the digitized time data.

In step 106, the control circuit 20 writes the time data acquired in step S105 to storage 22. Multiple time data are stored in the storage 22 as a result of the periodic repetition of step S105 and step S106.

In step 107, the reception controller 21 determines whether or not the number of coherent time data, which is time data that is mutually coherent, in the multiple time data stored in the storage 22 meets the threshold. The reception controller 21 evaluates whether or not the time data stored in the storage 22 in the most recent step S106 is coherent with other time data stored in the storage 22. If the number of coherent time data has reached the threshold, the reception controller 21 goes to step S108, and if the number of coherent time data is less than the threshold, the reception controller 21 goes to step S110.

In the first iteration of step S107 there is only one time data stored in the storage 22, and the reception controller 21 therefore goes to step S110.

In step 108, the time setting adjuster 24 executes a reception success process. More specifically, the time setting adjuster 24 corrects the internal time kept by the timekeeper 23 based on one of the time data among the coherent time data determined in step S107 to have coherence with other time data. The control circuit 20 executes the reception success process by setting the internal time to the current time matching the coherent time data.

In step 109, the reception controller 21 ends the reception process started in step S101.

In step 110, the reception controller 21 determines whether or not a specific time shorter than the time limit has past since the reception process started in step S101. If the specific time has past, the reception controller 21 goes to step S111, and if the specific time has not past, the reception controller 21 returns to step S105.

In step 111, the reception controller 21 determines whether or not the difference between the threshold and the number of coherent time data is 1. For example, if the threshold is 3, the reception controller 21 calculates the difference between the threshold and the number of coherent time data by subtracting the number of coherent time data stored in the storage 22 from 3. If the difference is 1, the reception controller 21 goes to step S112, and if the difference is not 1, the reception controller 21 goes to step S115.

In step 112, the reception controller 21 determines if the number of times the time limit was extended is less than a previously set maximum count. The reception controller 21 thus sets an upper limit to the number of times the time limit is extended. The maximum number of extensions in this example is 10.

This maximum number of extensions may be set according to the battery capacity or the transmittance of the dial to light passing through to a solar cell.

This maximum number of extensions is determined, for example, with consideration for power consumption so that the maximum time the reception process may continue by extending the time limit is within approximately twice the time limit of the initial setting.

If the number of extensions is less than the set maximum, the reception controller 21 goes to step S113, but if the number of extensions has reached the maximum, the reception controller 21 goes to step S115.

In step 113, the reception controller 21 extends the time limit of the reception process executed by the receiver circuit 12. For example, the reception controller 21 extends the time limit by adding one minute to the time limit, and then returns to step S105.

In step 114, the reception controller 21 determines if the reception process was completed for all broadcasting stations 5. More specifically, the reception controller 21 previously stores the types of multiple time signals that can be received, and determines whether or not all of the multiple time signal were received in the reception process started in the most recent step S101.

If the reception process was completed for all broadcasting stations 5, the reception controller 21 goes to step S115, and if the reception process was not completed, the reception controller 21 returns to step S102.

In step 115, the reception controller 21 executes the reception failure process. More specifically, the reception controller 21 sets a timing for repeating the reception process, and then ends the reception process in step S109.

In general, if the number of coherent time data does not reach the threshold within the time limit, the time data reception process is determined to have failed, all time data acquired within that time limit is deleted, and the reception process is attempted again at another time. This is because the correct time data cannot be acquired from time data that is not coherent, and it is possible that the reception environment of the radio-controlled timepiece 1 will be different the next time the reception process executes. In this case, in addition to the time data acquired in the last reception process being wasted, the same amount of power consumed in the last reception process may be consumed the next time.

However, if the difference between the threshold, which is the number of coherent time data for which reception was successful, and the number of coherent time data stored in the storage 22 is 1 when the specific time has past since the start of the reception process, the time limit of the reception process is extended. This is because compared with when no coherent time data has been received, when a certain amount of coherent time data has already been acquired at the time the specific time has past, the likelihood is high that the number of coherent time data will be increased by extending the reception process.

For example, when one successful time data reception process per day is set as the successful reception target, if the deficient coherent time data can be acquired by extending the time limit, there is no need to repeat the reception process again at the same time, and overall power consumption can therefore be reduced. In addition, by not changing the threshold, a drop in the accuracy of the time correct can be suppressed.

However, if a limit is not set for the number of times the time limit can be extended or the time, the reception process may continue endlessly and power consumption increase accordingly. As a result, an upper limit is set in the radio-controlled timepiece 1 for the number of times the time limit can be extended in order to suppress an increase in power consumption. In addition, when the beginning of the time code cannot be acquired in the time signal reception process, the likelihood is high that time data cannot be acquired from the time signal being received. The radio-controlled timepiece 1 therefore determines that time signal reception failed when the beginning of the time code cannot be acquired, and can suppress unnecessary power consumption by changing the reception target to a different time signal.

Figure 6:
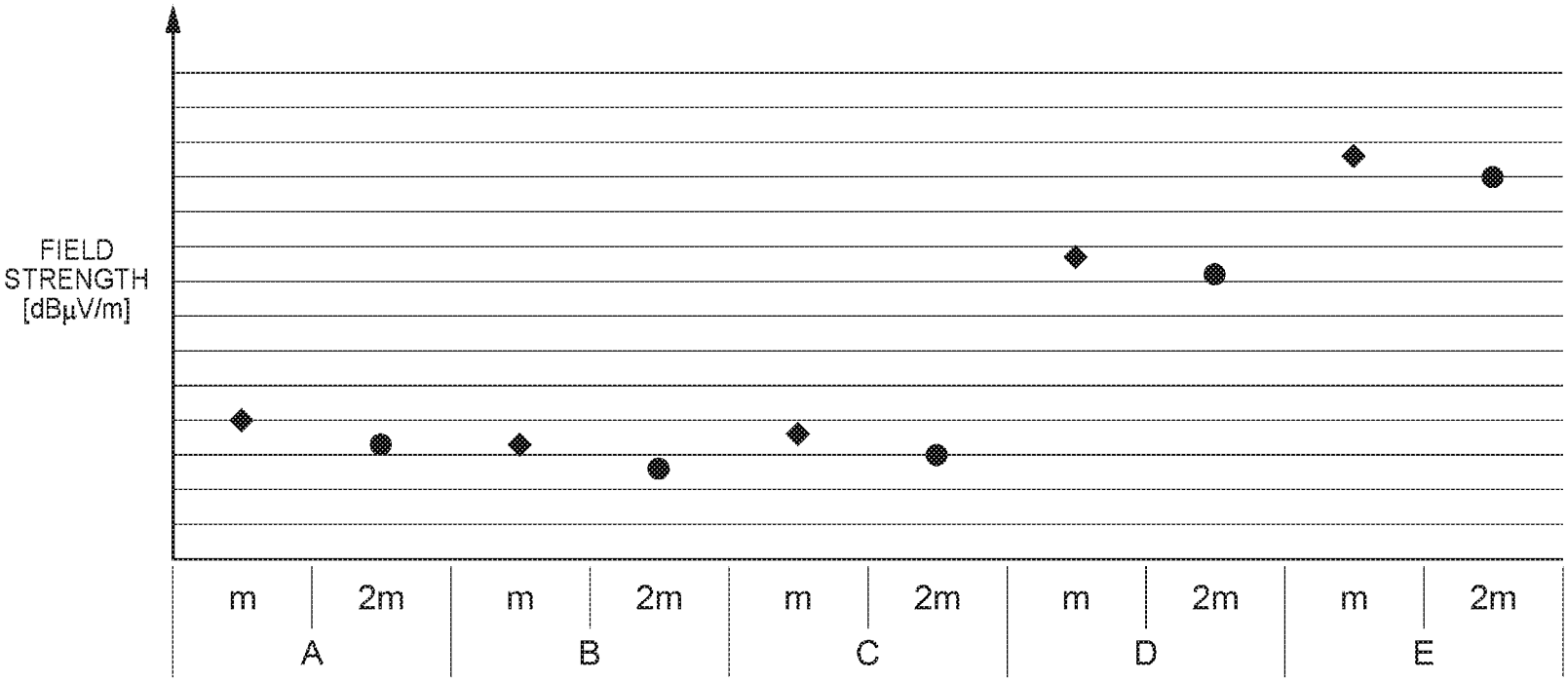
FIG. 6 is a graph of the results of measuring the average reception sensitivity in a limited time.

FIG. 6 is a graph showing the results of measuring the average reception sensitivity in each time limit period in the reception processes of time signals A to E. For the measurements, time data for one minute, that is, one time code, was acquired when the beginning of a time code was detected, the reception process was determined successful when the number of coherent time data reached 3, and the average reception sensitivity of the acquired time data was then calculated. The reception sensitivity corresponds to the field strength during time signal reception. Measurements were made at various locations to receive time signals A to E.

As shown in FIG. 6, the average field strength (dB μV/m) when the reception process of each time signal was successful was measured, the averages when the time limit was m minutes are indicated by a black diamond, and the averages when the time limit was 2 m minutes are indicated by a black dot. For each time signal, the longer the time limit, or more specifically a greater number of acquired time data, indicates a lower field strength. In other words, under conditions in which time data can be acquired, a longer time limit indicates higher reception sensitivity, and a higher likelihood of the reception process being successful was confirmed.

First Variation

A first variation of the foregoing embodiment is described below with reference to the flowchart in FIG. 7. This first variation differs from the embodiment described above in that the radio-controlled timepiece 1 extends the time limit when two or more time data in which a specific part of the information is coherent are stored.

Note that configurations, operations, and effects not described below in this variation are the same as in the embodiment described above, and redundant description thereof is omitted.

Of the multiple time data other than the coherent time data stored in the storage 22, time data in which a specific part of the information is mutually coherent is referred to below as partially coherent time data. For example, of the multiple time data that is not coherent time data in the example in FIG. 4, the third and sixth time data were each acquired on the same date and have the same year, month, and day, and are therefore partially coherent time data with respect to the year, month, and day values. The information of a specific part may also be other information such as the number of days since January 1, the year, day of week, and leap second.

Figure 5:
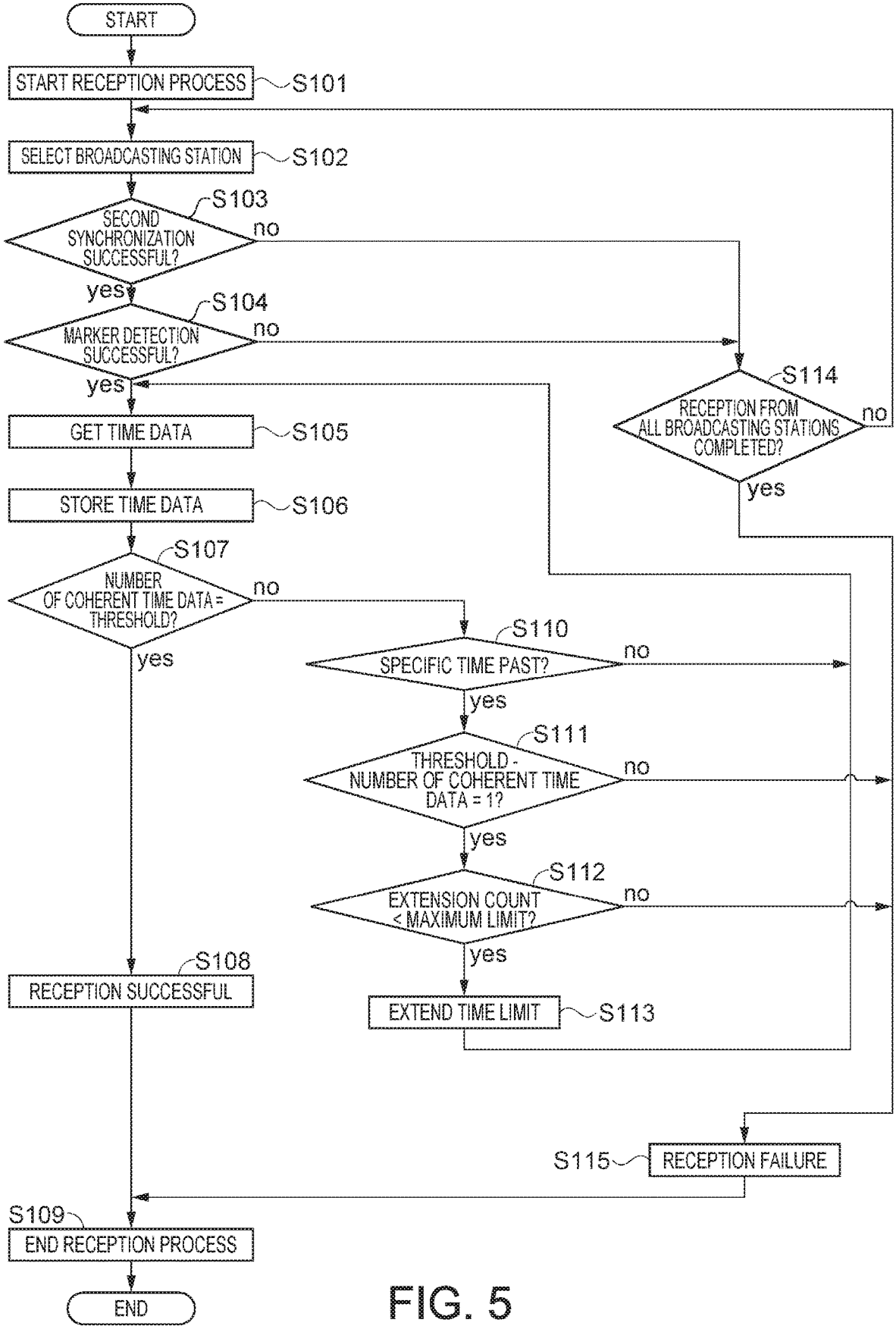
FIG. 5 is a flow chart describing the operation of a radio-controlled timepiece.
Figure 7:
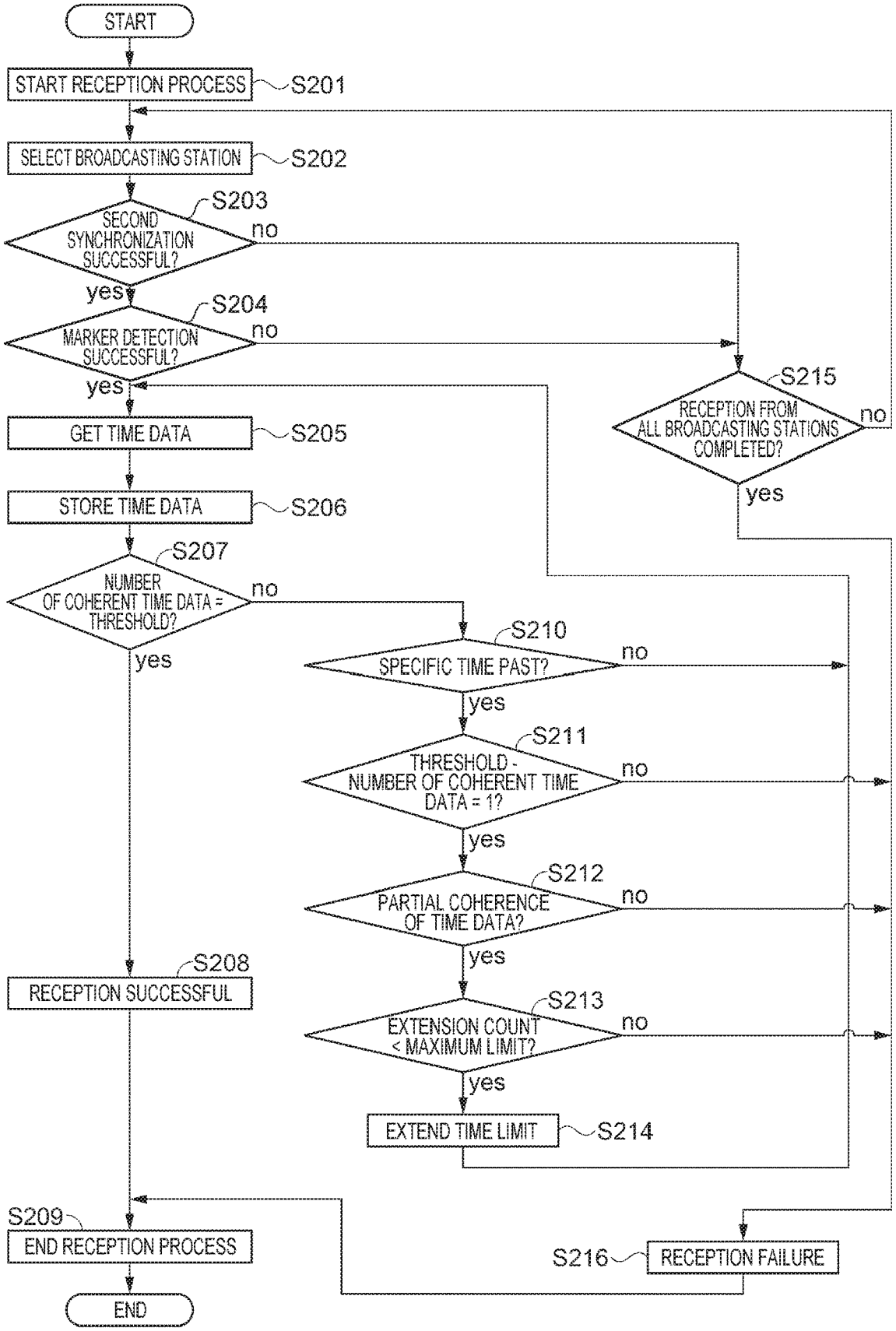
FIG. 7 is a flow chart describing the operation of a radio-controlled timepiece according to a first variation.

The process shown in the flow chart in FIG. 7 is the same as the process in FIG. 5 except for the addition of step S212. More specifically, the process of steps S201 to S211, and steps S213 to S216, is the same as the process of steps S101 to S111, and steps S112 to S115, in FIG. 5, and redundant description thereof is omitted.

When a specific time has past in step S211, in step 212 the reception controller 21 determines whether or not a specific part of the multiple time data stored in storage 22 is mutually coherent. More specifically, the reception controller 21 determines whether or not the multiple time data other than coherent time data stored in the storage 22 includes two partially coherent time data each containing mutually coherent information in a specific part thereof.

When the multiple time data in the storage 22 includes partially coherent time data, the reception controller 21 goes to step S213, and when the multiple time data does not include partially coherent time data, the reception controller 21 goes to step S216.

Therefore, in this first variation of the foregoing embodiment, the radio-controlled timepiece 1 extends the time limit of the reception process when the difference between the threshold and the number of coherent time data is 1, and the time data in the storage 22 includes partially coherent time data.

When the time data in the storage 22 does not include partially coherent time data, the reception failure process executes and the reception process ends. In this way the radio-controlled timepiece 1 can improve the likelihood of reducing overall power consumption by extending the time limit of the reception process when there is a strong likelihood of the reception process being successful if the time limit is extended.

Variation 2

A second variation of the foregoing embodiment is described below with reference to the flowchart in FIG. 8. In this second variation, the radio-controlled timepiece 1 extends the time limit of the reception process when the difference between the threshold and the number of coherent time data is 2, and the time data in the storage 22 includes partially coherent time data.

Figure 8:
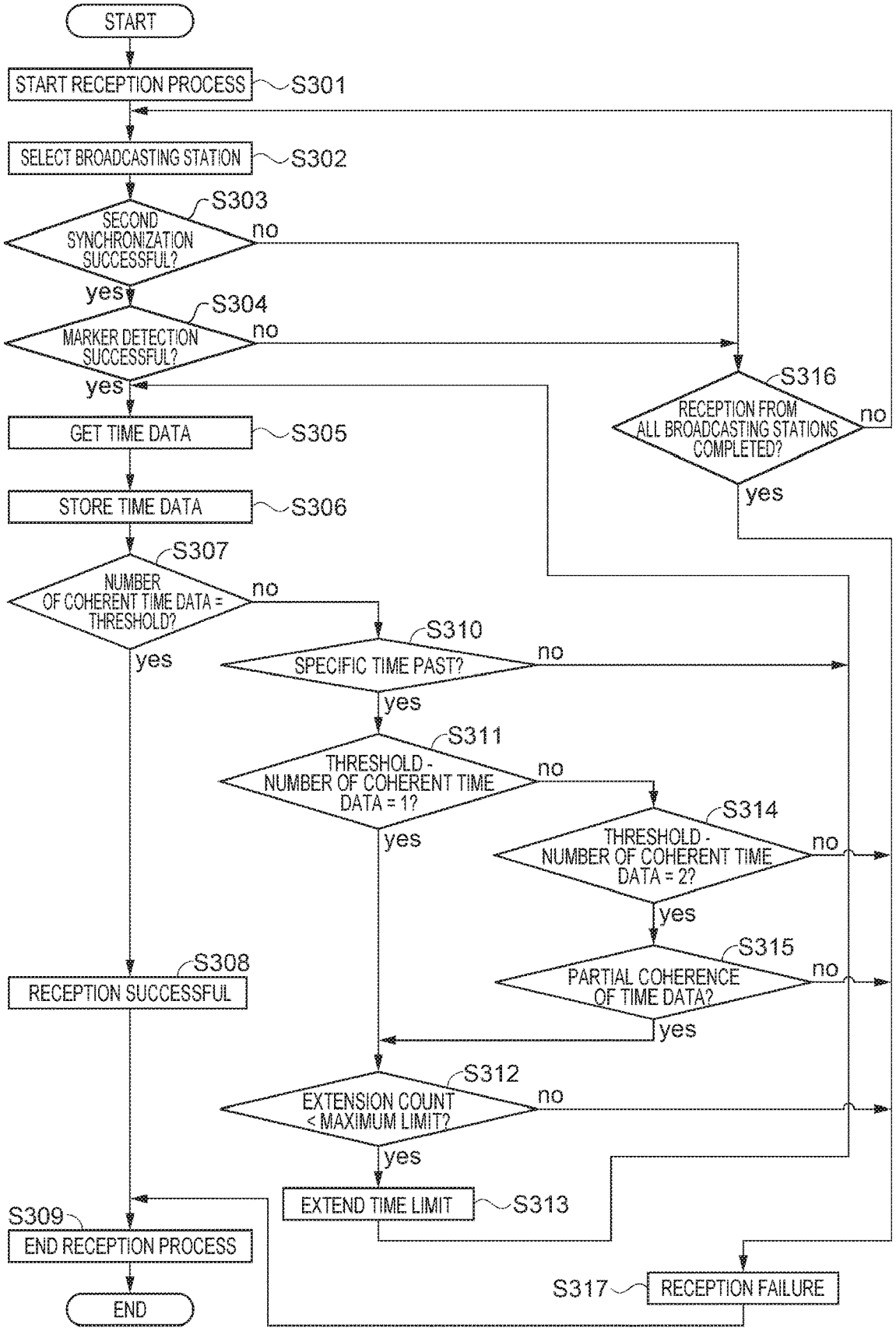
FIG. 8 is a flow chart describing the operation of a radio-controlled timepiece according to a second variation.

The process shown in the flow chart in FIG. 8 differs from the process in FIG. 5 by the addition of steps S314 and S315. More specifically, the process of steps S301 to S313, and steps S316 to S317 is the same as the process of steps S101 to S113, and steps S114 to S115 in FIG. 5, and redundant description thereof is omitted.

When the difference in step S311 is not 1, the reception controller 21 determines in step 314 whether or not the difference between a threshold and the number of coherent time data is 2. If the difference is 2, the reception controller 21 goes to step S315, and if the difference is not 2, the reception controller 21 goes to step S317.

In step 315, the reception controller 21 determines whether or not the multiple time data other than coherent time data stored in the storage 22 includes two partially coherent time data each containing mutually coherent information in a specific part of the time data.

When the multiple time data in the storage 22 includes partially coherent time data, the reception controller 21 goes to step S312, and when the multiple time data does not include partially coherent time data, the reception controller 21 goes to step S317.

Therefore, in addition to when the difference between the threshold and the number of coherent time data is 1, this second variation also extends the time limit of the reception process when the difference between the threshold and the number of coherent time data is 2 and the time data in the storage 22 includes partially coherent time data.

In addition, when the difference between the threshold and the number of coherent time data is greater than 2, and the time data in the storage 22 does not include partially coherent time data, the radio-controlled timepiece 1 executes a reception failure process and ends the reception process.

The radio-controlled timepiece 1 according to this variation can thus improve the likelihood that the reception process will succeed by adding another condition (opportunity) to extend the time limit, and the possibility of reducing overall power consumption can be improved.

OTHER EMBODIMENTS

Preferred embodiments of the present disclosure are described above, but the invention is not limited thereof. The configuration of various parts may be replaced by other desirable configurations having the same function, and desired configurations in the foregoing embodiments may be omitted or added within the scope of the accompanying claims. Other variations and improvements will also be apparent from this disclosure to one skilled in the related art.

For example, the maximum number of times the time limit may be extended in the foregoing embodiments is determined so that the maximum time the reception process may continue by extending the time limit is approximately twice the time limit of the initial setting.

However, the maximum number of extensions may be changed appropriately according to various conditions. For example, the radio-controlled timepiece 1 anticipates locations where two mutually different standard time signals can be received, such as JJY40 and JJY60 in Japan, or Britain's MSF and Germany's DCF77. In this scenario, when the reception process of one standard time signal is not successful, the radio-controlled timepiece 1 may succeed in the reception process for the other standard time signal. As a result, when the ability to receive two different standard time signals is anticipated, if the maximum number of extensions is changed so that the maximum time of the reception process is approximately 1.3 times the time limit, the reception process can be made to succeed more quickly, and the overall power consumption of the reception process can be reduced.

The maximum value may be previously set according to the anticipated operating region of the radio-controlled timepiece 1, for example, changed according to the types of standard time signals that may be received.

In the first and second variations above, the reception controller 21 determines whether or not there are two partially coherent time data, but the reception controller 21 may determine if there are three or more.

The reception controller 21 evaluates the information in only one specific part of the time data stored in the storage 22 to identify partially coherent time data, but is not so limited and may evaluate information in multiple parts. More specifically, the reception controller 21 may determine whether or not to extend the time limit based on whether or not multiple types of partially coherent time data are found.

The invention may also obviously include configurations not described above, including configurations sharing configurations described above. The technical scope of the invention is defined only by elements of the invention described in the scope of the claims of the invention reasonably derived from the foregoing description.

Specific aspects of the present disclosure may be derived from the foregoing embodiments as described below.

A first aspect of the present disclosure is a radio-controlled timepiece comprising an antenna for receiving standard time signals; a receiver circuit that executes during a specific time limit a reception process for acquiring multiple time data from the standard time signals at different times; storage for storing the multiple time data; a timekeeper that keeps internal time; a time adjuster that corrects the internal time using coherent time data when the number of coherent time data, which is time data that is mutually coherent, in the multiple time data reaches a threshold; and a reception controller that extends the time limit when the number of coherent time data is less than the threshold when a specific time that is shorter than the time limit has past since the start of the reception process.

This first aspect of the present disclosure extends the time limit of the reception process if the number of coherent time data has not reached a threshold when a specific time has past since the start of the reception process. If the deficient number of coherent time data can be acquired by extending the time limit, the reception process may not be necessary at the next time. As a result, this aspect of the invention can reduce the overall time required for successful reception, and the overall power consumption can be reduced.

A second aspect of the present disclosure is the first aspect of the present disclosure wherein the reception controller extends the time limit when the difference between the threshold and the number of coherent time data is 1.

The radio-controlled timepiece according to this second aspect of the present disclosure extends the time limit of the reception process when the number of coherent time data already received by the time the specific time has past is one less than the threshold.

In this case, the likelihood that the reception process will be unnecessary the next time is high because the likelihood is high that the number of coherent time data will reach the threshold by extending the reception period. As a result, this aspect of the invention can reduce the overall time required for successful reception, and the overall power consumption can be reduced.

A third aspect of the present disclosure is the second aspect of the present disclosure wherein the reception controller extends the time limit when multiple time data other than the coherent time data includes two time data each containing mutually coherent information in part thereof.

In this third aspect of the present disclosure, the radio-controlled timepiece extends the time limit of the reception process when the difference between the threshold and the number of coherent time data is 1, and the data in the storage includes partially coherent time data.

By extending the time limit only when the likelihood that the reception process will succeed as a result of extending the time limit, this third aspect of the present disclosure can improve the likelihood of reducing overall power consumption.

A fourth aspect of the present disclosure is the second aspect of the present disclosure wherein the reception controller extends the time limit when the difference between the threshold and the number of coherent time data is two, and the multiple time data other than the coherent time data includes two time data each containing mutually coherent information in part thereof.

In this fourth aspect of the present disclosure, the radio-controlled timepiece extends the time limit of the reception process both when the difference between the threshold and the number of coherent time data is one, and when the difference between the threshold and the number of coherent time data is two and the data in the storage includes partially coherent time data.

By increasing opportunities to extend the time limit, this fourth aspect of the present disclosure can improve the likelihood that the reception process will succeed.

A fifth aspect of the present disclosure is any of the first to fourth aspects of the present disclosure wherein an upper limit is set for the number of times the reception controller extends the time limit.

By setting an upper limit for the number of times the time limit may be extended, the radio-controlled timepiece according to this fifth aspect of the present disclosure can suppress increasing power consumption by unnecessarily continuing the reception process.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A radio-controlled timepiece comprising:

an antenna configured to receive a standard time signal;

a receiver circuit configured to execute during a specific time limit a reception process to acquire multiple time data from the standard time signal at different times;

storage configured to store the multiple time data;

a timekeeper configured to keep internal time;

a time adjuster configured to correct the internal time based on coherent time data when the number of coherent time data, which is time data that is mutually coherent, in the multiple time data reaches a threshold; and a reception controller configured to extend the time limit in response to a determination that (i) the number of coherent time data is less than the threshold but within a predetermined range of the threshold and (ii) a specific time that is shorter than the time limit has passed since the reception process started such that the time limit is extended prior to the time limit being reached.

2. The radio-controlled timepiece described in claim 1, wherein:

the reception controller extends the time limit when a difference between the threshold and the number of coherent time data is 1.

3. The radio-controlled timepiece described in claim 2, wherein:

the reception controller extends the time limit when multiple time data other than the coherent time data includes two time data each containing partially mutually coherent information, wherein at least part of each of the two time data is not mutually coherent.

4. The radio-controlled timepiece described in claim 1, wherein:

the reception controller extends the time limit when a difference between the threshold and the number of coherent time data is two, and the multiple time data other than the coherent time data includes two time data each containing partially mutually coherent information, wherein at least part of each of the two time data is not mutually coherent.

5. The radio-controlled timepiece described in claim 1, wherein:

an upper limit is set for the number of times the reception controller extends the time limit.

* * * * *